US009130257B2

(12) United States Patent
Vangala

(10) Patent No.: US 9,130,257 B2
(45) **Date of Patent: *Sep. 8, 2015**

(54) DIELECTRIC WAVEGUIDE FILTER WITH STRUCTURE AND METHOD FOR ADJUSTING BANDWIDTH

(71) Applicant: Reddy Vangala, Albuquerque, NM (US)

(72) Inventor: Reddy Vangala, Albuquerque, NM (US)

(73) Assignee: CTS CORPORATION, Elkhart, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/467,145

(22) Filed: Aug. 25, 2014

(65) Prior Publication Data

US 2014/0361853 A1 Dec. 11, 2014

Related U.S. Application Data

(63) Continuation of application No. 13/103,712, filed on May 9, 2011, now Pat. No. 8,823,470.

(60) Provisional application No. 61/345,382, filed on May 17, 2010.

(51) Int. Cl.
*H01P 1/20* (2006.01)
*H01P 7/10* (2006.01)
(Continued)

(52) U.S. Cl.
CPC ..... *H01P 1/2002* (2013.01); *H01P 1/2088* (2013.01); *H01P 7/10* (2013.01); *H01P 11/008* (2013.01)

(58) Field of Classification Search
CPC ..... H01P 1/2002; H01P 7/10; H01P 11/008
USPC ..... 333/202–212, 219.1
See application file for complete search history.

(56) References Cited

U.S. PATENT DOCUMENTS 4,431,977 A 2/1984 Sokola et al.
4,609,892 A 9/1986 Higgins, Jr.
(Continued)

FOREIGN PATENT DOCUMENTS

CN 201898182 U 7/2011
CN 102361113 A 2/2012
(Continued)

OTHER PUBLICATIONS

Ruiz-Cruz J et al: "Rectangular Waveguide Elliptic Filters with Capacitive and Inductive Irises and Integrated Coaxial Excitation", 2005 IEEE MTT-S International Microwave Symposium, Piscataway, NJ, USA, IEEE, (Jun. 12, 2005) pp. 269-272, EP010844740, DOI: 10.1109/MWSYM.2005.1516577, ISBN: 978-0-7803-8846-8 p. 269; figures 1,3.
(Continued)

*Primary Examiner* — Benny Lee
*Assistant Examiner* — Rakesh Patel
(74) *Attorney, Agent, or Firm* — Daniel J. Deneufbourg

(57) ABSTRACT

A structure and method for adjusting the bandwidth of a ceramic waveguide filter comprising, in one embodiment, a monoblock of dielectric ceramic material defining respective steps and respective input/output through-holes extending through the monoblock and the respective steps. In one embodiment, the steps are defined by notches in the monoblock and the input/output through-holes define openings terminating in the notch. The bandwidth of the ceramic waveguide filter may be adjusted by adjusting the height/thickness and direction of the steps relative to an exterior surface of the monoblock and/or the diameter of the input/output through-holes.

6 Claims, 5 Drawing Sheets

(51) Int. Cl.
*H01P 11/00* (2006.01)
*H01P 1/208* (2006.01)

(56) References Cited

U.S. PATENT DOCUMENTS 4,692,726 A 9/1987 Green et al.
4,706,051 A 11/1987 Dieleman et al.
4,733,208 A 3/1988 Ishikawa et al.
4,742,562 A 5/1988 Kommrusch
4,800,348 A 1/1989 Rosar et al.
4,806,889 A * 2/1989 Nakano et al. ..... 333/202
4,837,535 A 6/1989 Konishi et al.
4,940,955 A 7/1990 Higgins, Jr.
4,963,844 A 10/1990 Konishi et al.
4,996,506 A 2/1991 Ishikawa et al.
5,004,992 A 4/1991 Grieco et al.
5,023,944 A 6/1991 Bradley
5,130,682 A 7/1992 Agahi-Kesheh
5,208,565 A 5/1993 Sogo et al.
5,285,570 A 2/1994 Fulinara
5,288,351 A 2/1994 Hoang et al.
5,365,203 A 11/1994 Nakamura et al.
5,382,931 A 1/1995 Piloto et al.
5,416,454 A 5/1995 McVetty
5,525,946 A 6/1996 Tsujiguchi et al.
5,528,204 A 6/1996 Hoang et al.
5,528,207 A 6/1996 Ito
5,537,082 A 7/1996 Tada et al.
5,572,175 A 11/1996 Tada et al.
5,602,518 A 2/1997 Clifford, Jr. et al.
5,719,539 A 2/1998 Ishizaki et al.
5,731,751 A 3/1998 Vangala
5,821,836 A 10/1998 Katehi et al.
5,850,168 A 12/1998 McVetty et al.
5,926,078 A 7/1999 Hino et al.
5,926,079 A 7/1999 Heine et al.
5,929,726 A 7/1999 Ito et al.
5,999,070 A 12/1999 Endo
6,002,306 A 12/1999 Arakawa et al.
6,023,207 A 2/2000 Ito et al.
6,137,383 A 10/2000 De Lillo
6,154,106 A 11/2000 De Lillo
6,160,463 A 12/2000 Arakawa et al.
6,181,225 B1 1/2001 Bettner
6,255,921 B1 7/2001 Arakawa et al.
6,281,764 B1 8/2001 Arakawa et al.
6,329,890 B1 12/2001 Brooks et al.
6,351,198 B1 2/2002 Tsukamoto et al.
6,437,655 B1 8/2002 Andoh et al.
6,504,446 B1 1/2003 Ishihara et al.
6,535,083 B1 3/2003 Hageman et al.
6,549,095 B2 4/2003 Tsukamoto et al.
6,559,740 B1 5/2003 Schulz et al.
6,568,067 B2 5/2003 Takeda
6,594,425 B2 7/2003 Tapalian et al.
6,677,837 B2 1/2004 Kojima et al.
6,757,963 B2 7/2004 Meier et al.
6,791,403 B1 9/2004 Tayrani et al.
6,801,106 B2 10/2004 Ono et al.
6,834,429 B2 12/2004 Blair et al.
6,844,861 B2 1/2005 Peterson
6,888,973 B2 5/2005 Kolodziejski et al.
6,900,150 B2 5/2005 Jacquin et al.
6,909,339 B2 6/2005 Yonekura et al.
6,909,345 B1 6/2005 Salmela et al.
6,927,653 B2 8/2005 Uchimura et al.
6,977,560 B2 12/2005 Iroh et al.
6,977,566 B2 12/2005 Fukunaga
7,009,470 B2 3/2006 Yatabe et al.
7,068,127 B2 6/2006 Wilber et al.
7,132,905 B2 11/2006 Sano
7,142,074 B2 11/2006 Kim et al.
7,170,373 B2 1/2007 Ito et al.
7,271,686 B2 9/2007 Yoshikawa et al.
7,323,954 B2 1/2008 Lee et al.
7,449,979 B2 11/2008 Koh et al.
7,545,235 B2 6/2009 Mansour et al.
7,659,799 B2 2/2010 Jun et al.
7,714,680 B2 5/2010 Vangala et al.
8,008,993 B2 8/2011 Milson et al.
8,072,294 B2 12/2011 Tanpo et al.
8,171,617 B2 5/2012 Vangala
8,284,000 B2 10/2012 Fukunaga
8,314,667 B2 11/2012 Uhm et al.
8,823,470 B2 * 9/2014 Vangala ..... 333/212
2001/0024147 A1 9/2001 Arakawa et al.
2002/0024410 A1 2/2002 Guglielmi et al.
2004/0000968 A1 1/2004 White et al.
2004/0056737 A1 3/2004 Carpintero et al.
2004/0129958 A1 7/2004 Koh et al.
2004/0257194 A1 12/2004 Casey et al.
2007/0120628 A1 5/2007 Jun et al.
2009/0015352 A1 1/2009 Goebel et al.
2009/0102582 A1 4/2009 Van Der Heijden et al.
2009/0146761 A1 6/2009 Nummerdor
2009/0231064 A1 9/2009 Bates et al.
2010/0024973 A1 2/2010 Vangala
2010/0253450 A1 * 10/2010 Kim et al. ..... 333/239
2011/0279200 A1 11/2011 Vangala
2012/0229233 A1 9/2012 Ito
2012/0286901 A1 11/2012 Vangala
2013/0214878 A1 8/2013 Gorisee et al.

FOREIGN PATENT DOCUMENTS

DE 102008017967 A1 10/2009
EP 0322993 A2 7/1989
EP 0322993 A3 4/1990
EP 0444948 A2 3/1991
EP 0757401 A2 2/1997
EP 0859423 A1 8/1998
EP 1024548 A1 2/2000
EP 0997964 A2 5/2000
EP 0997964 A3 9/2001
EP 1439599 A1 7/2004
FR 2318512 A1 2/1977
JP 62038601 2/1987
JP 2003298313 10/2003
WO 9509451 4/1995
WO 0024080 4/2000
WO 2005091427 9/2005

OTHER PUBLICATIONS

Paul Wade: "Rectangular Waveguide to Coax Transition Design", QEX, Nov./Dec. 2006, pp. 10-17, published by American Radio Relay League, Newington, Connecticut, US.

Yoji Isota, Moritasu Miyazaki, Osami Ishida, Fumio Takeda, Mitsubishi Electric Corporation. "A Grooved Monoblock Comb-Line Filter Suppressing the Third Harmonics", IEEE 1987 MTT-S Digest, pp. 383-386, published by IEEE, New York, New York, US.

C. Choi, Fig. 2.13, Monolithic Plated Ceramic Waveguide Filters, Mar. 31, 1986, Motorola, Inc., Schaumburg, Illinois, U.S.

Kocbach J. et al: "Design Procedure for Waveguide Filters with Cross-Couplings", 2002 IEEE MTT-S International Microwave Symposium Digest (Cat. No. 02CH37278) IEEE Piscataway, NJ, USA; IEEE MTT-S International Microwave Symposium, IEEE, Jun. 2, 2002, pp. 1449-1452, XP001113877, DOI: 10.1109/WMSYM.2002.1012128 ISBN: 978-0/8703-7239-9 abstract; figure 1.

N. Marcuvitz, Waveguide Handbook, McGraw-Hill Book Co., New York City, Ch. 5, 1951.

Y. Konishi, "Novel dielectric waveguide components-microwave applications of new ceramic materials," Proc. IEEE, vo. 79, pp. 726-740, Jun. 1991.

K. Sano, "Dielectric waveguide filter with low profile and low insertion loss," IEEE Trans. on Microwave Theory & Tech., vol. 47, pp. 2299-2303, Dec. 1999.

K. Sano and T. Yoneyama, "A transition from Microstrip to Dielectric Filled Rectangular Waveguide in Surface Mounting," IEEE MTT-S Int. Microwave Symp. Digest, pp. 813-816, 2002.

(56) References Cited

OTHER PUBLICATIONS

I. Awai, A.C. Kundu, and T. Yamashita, "Equivalent circuit representation and explanation of attenuation poles of a dual-mode dielectric resonator bandpass filter," IEEE Trans. Microwave Theory & Tech., vol. 46, pp. 2159-2163, Dec. 1998.

A.D. Paidus and C. Rossiter, "Cross-coupling in microwave bandpass filters," Microwave Journal, pp. 22-46, Nov. 2004.

Tze-min Shen; Chi-Feng Chen' Huang, Ting-Yi; Wu, Ruey-Beei, "Design of Vertically Stacked Waveguide Filters in LTCC," Microwave Theory and Techniques, IEEE Transactions on, vol. 55, No. 8, pp. 1771, 1779, Aug. 2007.

Hung-Yi Chien; Tze-Min Shen; Huang; Ting-Yi; Wei-Hsin Wang; Wu, Ruey-Beei, "Miniaturized Bandpass Filters with Double-Folded Substrate Integrated Resonators in LTCC," Microwave Theory and Techniques, IEEE Transactions on vol. 57, No. 7, pp. 1774, 1782, Jul. 2009.

Bo-Jiun Chen; Tze-Min Shen; Wu, Ruey-Beei, "Dual Band Vertically Stacked Laminated Waveguide Filter Design in LTCC Technology," Microwave Theory and Techniques, IEEE Transactions on, vol. 57, No. 6, pp. 1554, 1562, Jun. 2009.

Wolfram Wersing, Microwave ceramics for resonators and filters, Current Opinion in Solid State and Materials Science, vol. 1, Issue 5, Oct. 1996, pp. 715-731, ISSN 1359-0286.

* cited by examiner

DIELECTRIC WAVEGUIDE FILTER WITH STRUCTURE AND METHOD FOR ADJUSTING BANDWIDTH

CROSS-REFERENCE TO RELATED APPLICATION

This application is a continuation application which claims the benefit of the filing date of co-pending U.S. patent application Ser. No. 13/103,712 filed on May 9, 2011, entitled Dielectric Waveguide Filter with Structure and Method for Adjusting Bandwidth, the disclosure of which is explicitly incorporated herein by reference as are all references cited therein, which claims the benefit of the filing date of U.S. Provisional Patent Application Ser. No. 61/345,382 filed on May 17, 2010, which is explicitly incorporated herein by reference as are all references cited therein.

FIELD OF THE INVENTION

The invention relates generally to dielectric waveguide filters and, more specifically, to a structure and method for adjusting the bandwidth of a dielectric waveguide filter.

BACKGROUND OF THE INVENTION

Ceramic dielectric waveguide filters are well known in the art. In the electronics industry today, ceramic dielectric waveguide filters are typically designed using an "all pole" configuration in which all resonators are tuned to the passband frequencies. With this type of design, one way to increase the attenuation outside of the passband is to increase the number of resonators. The number of poles in a waveguide filter determines important electrical characteristics such as passband insertion loss and stopband attenuation. The length and width of the resonant cavities, also known as resonant cells or resonators, help to set the center frequency of the waveguide filter.

U.S. Pat. No. 5,926,079 to Heine et al. shows a prior art ceramic dielectric monoblock waveguide filter in which five resonators are spaced longitudinally in series along the length of the monoblock and an electrical signal flows through successive resonators in series to form a passband. Waveguide filters of the type disclosed in U.S. Pat. No. 5,926,079 to Heine et al. are used for the same type of filtering applications as traditional dielectric monoblock filters with through-hole resonators of the type disclosed in, for example, U.S. Pat. No. 4,692,726 to Green et al. One typical application for waveguide filters is use in base-station transceivers for cellular telephone networks.

It is also well known in the art that the length and width of a ceramic waveguide filter such as, for example, the ceramic waveguide filter disclosed in U.S. Pat. No. 5,926,079 to Heine et al., defines and determines the passband frequency of the waveguide filter while the height/thickness of the waveguide filter determines the unloaded "Q" of the waveguide filter resonators and therefore the insertion loss in the passband of the waveguide filter. In U.S. Pat. No. 5,926,079 to Heine et al., the positioning of blind input/output holes centrally in monoblock bridge regions formed between the resonators and in a relationship adjacent slots defined in the monoblock provide the necessary external coupling bandwidth of the waveguide filter.

The plating of blind input-output holes during the manufacturing process however has proven unreliable and can lead to unpredictable filter performance. The use of plated input/output through-holes has proven satisfactory in certain applications including, for example, the relatively thin resonators of waveguide delay lines of the type disclosed in US Patent Application Publication No. 2010/0024973. However, coupling with plated input/output through-holes, when used with thick waveguide filters, limits the external bandwidth to unduly narrow band filters.

The present invention is thus directed to a new and novel structure and method for providing the necessary external bandwidth in a thick waveguide filter which includes plated input/output through-holes without an increase in the insertion loss of the waveguide filter.

SUMMARY OF THE INVENTION

The present invention relates generally to a waveguide filter comprising a monoblock of dielectric material including a plurality of exterior surfaces and at least one step including an exterior surface spaced from one of the exterior surfaces of the monoblock, and at least one input/output through-hole extending through the monoblock, the at least one input/output through-hole defining first and second openings in one of the exterior surfaces of the monoblock and the exterior surface of the at least one step respectively.

In one embodiment, the exterior surface of the at least one step extends inwardly from the one of the exterior surfaces of the monoblock and defines a notch in the monoblock and the second opening of the at least one input/output through-hole terminates in the notch.

In one embodiment, the waveguide filter further comprises an RF signal bridge defined in the monoblock and the RF signal bridge is located in the region of the monoblock with the notch to define a shunt zero.

In one embodiment, the monoblock includes a first end portion including a first end surface, the notch is defined in the first end portion, and the RF signal bridge is located in the monoblock between the first end surface and the at least one input/output through-hole.

In one embodiment, the RF signal bridge is defined by a slit extending into the monoblock and terminating in the notch.

In another embodiment, the exterior surface of the at least one step extends outwardly from the one of the exterior surfaces of the monoblock.

In one particular embodiment, the present invention is directed to a waveguide filter comprising a monoblock of dielectric material including a conductive exterior surface, at least first and second steps, and at least first and second input/output through-holes extending through the first and second steps and defining respective opposed first and second openings in the exterior surface of the monoblock and the first and second steps respectively.

The first and second steps are defined by respective first and second notches defined in the monoblock and the second openings of the first and second input/output through-holes terminate in the first and second notches respectively.

In one embodiment, the first and second notches are defined in respective first and second opposed end portions of the monoblock and a plurality of RF signal bridges extend along the length of the monoblock in a spaced-apart relationship to define a plurality of resonators.

Also, in one embodiment, the first and second end portions include respective first and second end surfaces and one of the plurality of RF signal bridges and the first input/output through-hole is located in the first end portion of the monoblock with the first notch defined therein in a relationship wherein the one of the plurality of RF signal bridges is located between the first end surface and the first input/output through-hole to define a first shunt zero.

In one embodiment, the first notch has a length greater than the second notch.

The present invention also relates to a method of adjusting the bandwidth of a waveguide filter comprising at least the following steps: providing a monoblock of dielectric material including an exterior surface, at least a first step, and at least a first input/output through-hole extending through the monoblock and terminating in respective openings in the first step and the exterior surface of the monoblock respectively; and adjusting the height of the step relative to the exterior surface of the monoblock to adjust the bandwidth of the waveguide filter.

In the embodiment where the step is defined by a notch defined in the monoblock, the step of adjusting the height of the step includes the step of adjusting the height of the notch.

In the embodiment where the step is defined by a projection on the monoblock, the step of adjusting the height of the step includes the step of adjusting the height of the projection.

The method may also further comprise the step of adjusting the diameter of the first input/output through-hole to adjust the bandwidth of the waveguide filter.

Other advantages and features of the present invention will be more readily apparent from the following detailed description of the preferred embodiments of the invention, the accompanying drawings, and the appended claims.

BRIEF DESCRIPTION OF THE DRAWINGS

These and other features of the invention can best be understood by the following description of the accompanying FIGURES as follows.

DETAILED DESCRIPTION OF THE EMBODIMENTS

Figure 1:
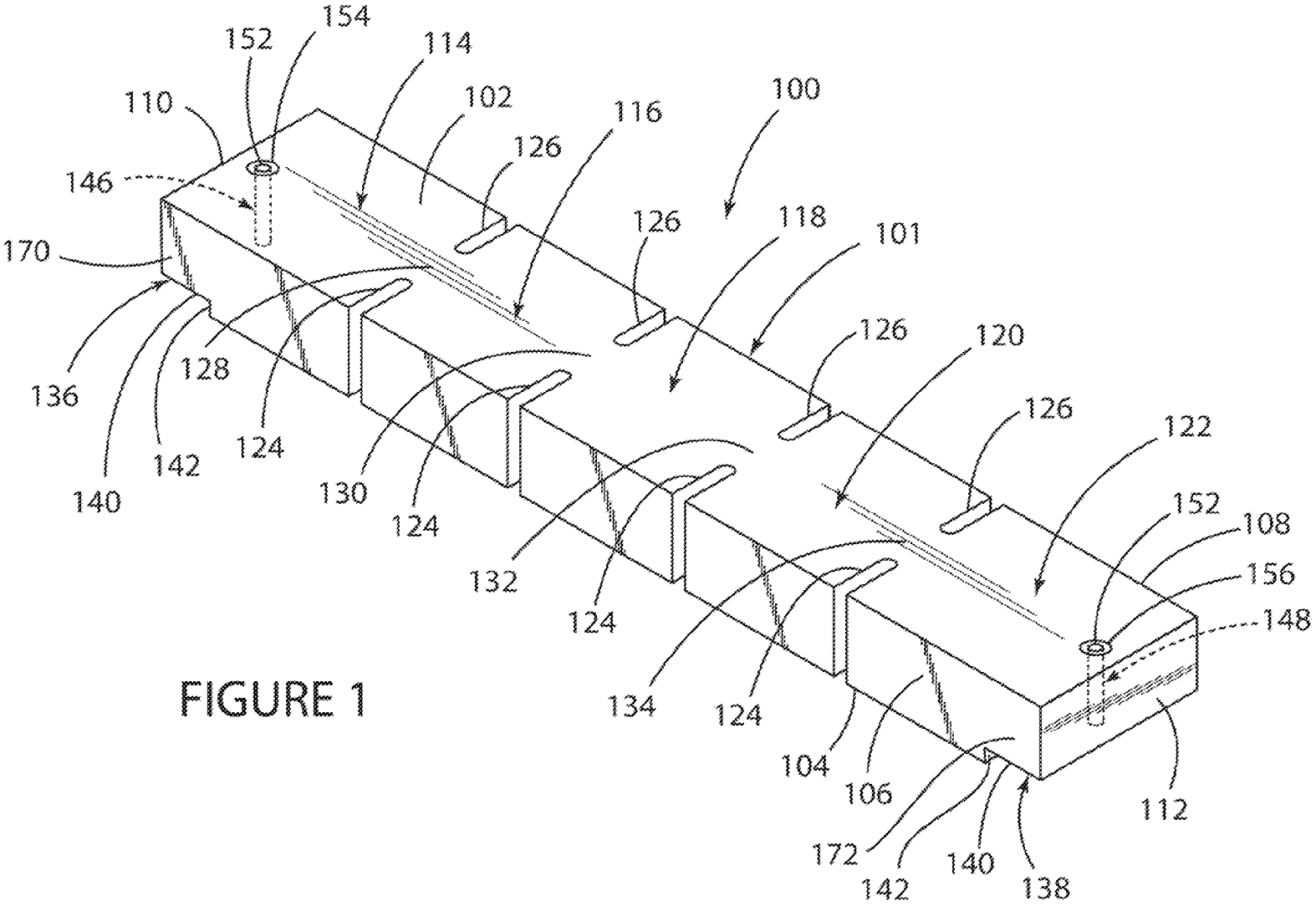
FIG. 1 is an enlarged perspective view of one embodiment of a ceramic dielectric waveguide filter according to the present invention.
Figures 2, 2A:
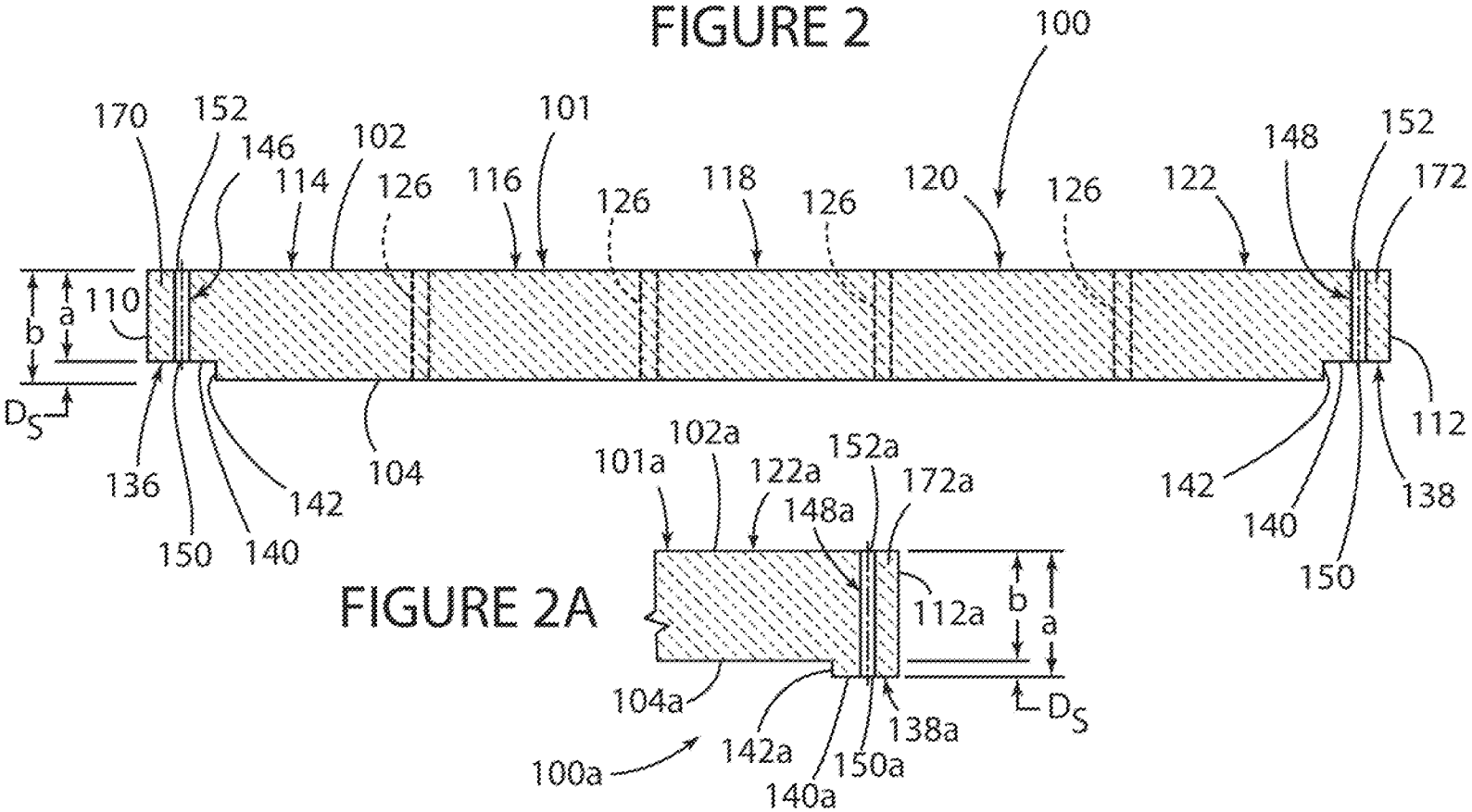
FIG. 2 is an enlarged vertical cross-sectional view of the ceramic dielectric waveguide filter shown in FIG. 1.
FIG. 2A is an enlarged, broken, vertical cross-sectional view of an alternate embodiment of a ceramic dielectric waveguide filter incorporating an outwardly projecting end step.

FIGS. 1 and 2 depict one embodiment of a ceramic dielectric waveguide filter 100 according to the present invention which is made from a generally parallelepiped-shaped monoblock 101, comprised of any suitable dielectric material such as for example ceramic, and having opposed longitudinal upper and lower horizontal exterior surfaces 102 and 104, opposed longitudinal side vertical exterior surfaces 106 and 108, and opposed transverse side vertical exterior end surfaces 110 and 112.

The monoblock 101 includes a plurality of resonant sections (also referred to as cavities or cells or resonators) 114, 116, 118, 120, and 122 which are spaced longitudinally along the length of the monoblock 101 and are separated from each other by a plurality of spaced-apart vertical slits or slots 124 and 126 which are cut into the surfaces 102, 104, 106, and 108 of the monoblock 101.

The slits 124 extend along the length of the side surface 106 of the monoblock 101 in a spaced-apart and parallel relationship. Each of the slits 124 cuts through the side surface 106 and opposed upper and lower horizontal surfaces 102 and 104 and partially through the body of the monoblock 101. The slits 126 extend along the length of the opposed side surface 108 of the monoblock 101 in a spaced-apart and parallel relationship and in a relationship opposed and co-planar with the respective slits 124 defined in the side surface 106. Each of the slits 126 cuts through the side surface 108 and opposed upper and lower horizontal surfaces 102 and 104 and partially through the body of the monoblock 101.

By virtue of their opposed, spaced, and co-planar relationship, the slits 124 and 126 together define a plurality of generally centrally located RF signal bridges 128, 130, 132, and 134 in the monoblock 101 which extend between and interconnect the respective resonators 114, 116, 118, 120, and 122. In the embodiment shown, the width of each of the RF signal bridges 128, 130, 132, and 134 is dependent upon the distance between the opposed slits 124 and 126 and, in the embodiment shown, is approximately one-third the width of the monoblock 101.

Although not shown in any of the FIGURES, it is understood that the thickness or width of the slits 124 and 126 and the depth or distance which the slits 124 and 126 extend from the respective one of the side surfaces 106 or 108 into the body of the monoblock 101 may be varied depending upon the particular application to allow the width and the length of the RF signal bridges 128, 130, 132, and 134 to be varied accordingly to allow control of the electrical coupling and bandwidth of the waveguide filter 100 and hence control the performance characteristics of the waveguide filter 100.

The waveguide filter 100 and, more specifically the monoblock 101 thereof, additionally comprises and defines respective opposed end steps or notches 136 and 138, each comprising a generally L-shaped recessed or grooved or shouldered or notched region or section of the lower surface 104, opposed side surfaces 106 and 108, and opposed side end surfaces 110 and 112 of the monoblock 101 from which dielectric ceramic material has been removed or is absent.

Stated another way, in the embodiment of FIGS. 1 and 2, the first and second steps 136 and 138 are defined in and by opposed end sections or regions 170 and 172 of the monoblock 101 having a height a (FIG. 2) less than the height b (FIG. 2) of the remainder of the monoblock 101.

Stated yet another way, in the embodiment of FIGS. 1 and 2, each of the steps 136 and 138 comprises a generally L-shaped recessed or notched portion of the respective end resonators 114 and 122 defined on the monoblock 101 which includes a first generally horizontal surface or ceiling 140 located or directed inwardly of, spaced from, and parallel to the lower surface 104 of the monoblock 101 and a second generally vertical surface or wall 142 located or directed inwardly of, spaced from, and parallel to, the respective side end surfaces 110 and 112 of the monoblock 101.

The waveguide filter 100 and, more specifically, the monoblock 101 thereof, additionally comprises first and second electrical RF signal input/output electrodes in the form of respective first and second through-holes 146 and 148 extending through the body of the monoblock 101 and, more specifically, through the body of the respective end resonators 114 and 122 defined in the monoblock 101 between, and in relationship generally normal to, the surface 140 of the respective steps 136 and 138 and the upper surface 102 of the monoblock 101. Still more specifically, each of the generally cylindrically-shaped input/output through-holes 146 and 148 is spaced from and generally parallel to the respective transverse side end surfaces 110 and 112 of the monoblock 101 and defines respective generally circular openings 150 and 152 located and terminating in the step surface 140 and the monoblock upper surface 102 respectively.

In the embodiment of FIGS. 1 and 2, the RF signal input/output through-hole 146 is located and positioned in and extends through the interior of the monoblock 101 between and, in a relationship generally spaced from and parallel to, the side end surface 110 and the step wall or surface 142 while the RF signal input/output through-hole 148 is located and positioned in and extends through the interior of the monoblock 101 between, and in a relationship generally spaced from and parallel to, the side end surface 112 and the step wall or surface 142.

All of the external surfaces 102, 104, 106, 108, 110, and 112 of the monoblock 101 and the internal surfaces of the input/output through-holes 146 and 148 are covered with a suitable conductive material such as, for example, silver with the exception of respective uncoated (exposed ceramic) generally circular regions or rings 154 and 156 on the monoblock upper surface 102 which surround the openings 152 of the respective input/output through-holes 146 and 148. Although not shown in any of the FIGURES, it is understood that the regions 154 and 156 can instead surround the openings 150 defined by the respective input/output through-holes 146 and 148 in the horizontal surface or ceiling 140 of each of the steps 136 and 138.

In accordance with the present invention, the addition in a waveguide filter of one or both of the respective steps 136 and 138 only in the respective regions of the monoblock 101 incorporating the input/output through-holes 146 and 148 (i.e., the regions of the monoblock 101 with the respective end resonators 114 and 122 of reduced height) allows the external bandwidth/coupling/Q value of the filter 100 (i.e., a key parameter in the design and performance of bandpass filters which is dependent upon the bandwidth of the two end resonators 114 and 122 and has a value which is proportionally higher than the internal bandwidth of the filter) to be adjusted with minimal effect on the insertion loss of the filter 100 because the reduction in monoblock height has been restricted only to a small portion of the monoblock 101.

The addition of one or both of the respective steps 136 and 138 only in the region of the respective input/output through-holes 146 and 148 also advantageously allows the monoblock 101 to be manufactured with input/output through-holes extending fully through the monoblock 101 rather than only partially therethrough as with the blind holes disclosed in U.S. Pat. No. 5,926,079 which are more difficult to manufacture.

Moreover, and although FIGS. 1 and 2 depict a waveguide filter 100 with respective steps 136 and 138 defined by respective recessed or notched end regions or sections of the monoblock 101 from which dielectric material has been removed or is absent (i.e., a "step down" or "step in" region of the monoblock 101 of reduced height/thickness relative to the height/thickness of the remainder of the monoblock 101 which is directed and extends inwardly into the body of the monoblock from the surface 104 of the monoblock 101), it is understood that the invention encompasses the alternate waveguide filter embodiment in which one or both of the notches 136 and 138 have been replaced or substituted with a projection such as, for example, the projection 138*a* depicted in the waveguide filter embodiment 100*a* shown in FIG. 2A.

More specifically, in FIG. 2A, the step is defined by an end region or section 172*a* of a monoblock 101*a* having a height a (FIG. 2A) greater than the height b (FIG. 2A) of the remainder of the monoblock 101 (i.e., a "step up" or "step out" region or projection 138*a* of increased thickness/height relative to the thickness/height of the remainder of the monoblock 101*a* which is directed and projects outwardly from the lower horizontal longitudinal surface 104*a* of the monoblock 101*a*.

Thus, more specifically, the monoblock 101*a* comprises and defines an end step or projection 138*a* comprising an outwardly and exteriorly extending shouldered region or section of the lower surface 104*a*, opposed side surfaces (not shown), and side end surface 112*a* of the monoblock 101*a*. Stated another way, the step 138*a* comprises an outwardly shouldered portion of the monoblock 101*a* and, more specifically, an outwardly shouldered portion of the end resonator 122*a* which includes a first generally horizontal exterior surface 140*a* located or directed outwardly of, spaced from, and parallel to the lower surface 104*a* of the monoblock 101*a* and a second generally vertical surface or wall 142*a* located or directed inwardly of, spaced from, and parallel to, the respective side end surface 112*a* of the monoblock 101*a*.

The waveguide filter 100*a* and, more specifically, the monoblock 101*a* thereof, additionally comprises an electrical RF signal input/output electrode in the form of a first through-hole 148*a* extending through the body of the monoblock 101*a* and, more specifically, extending through the body of the end resonator 122*a* between, and in relationship generally normal to, the surface 140*a* of the step 138*a* and the upper surface 102*a* of the monoblock 101*a*. Still more specifically, the generally cylindrically-shaped input/output through-hole 148*a* is spaced from and generally parallel to the transverse side end surface 112*a* of the monoblock 101*a* and defines respective generally circular openings 150*a* and 152*a* located and terminating in the step surface 140*a* and the monoblock upper surface 102*a* respectively.

Thus, in the embodiment of FIG. 2A, the RF signal input/output through-hole 148*a* is located and positioned in and extends through the interior of the monoblock 101*a* between and in a relationship generally spaced from and parallel to the side end surface 112*a* and the step wall or surface 142*a*.

In accordance with the embodiment of FIG. 2A, the incorporation in a waveguide filter of an outward step or projection 138*a* only in the region of the monoblock 101*a* incorporating the input/output through-hole 148*a* allows the external bandwidth/coupling of the filter 100*a* to be adjusted with minimal effect on the insertion loss of the filter 100*a* because the increase in monoblock height/thickness has been restricted only to a small portion of the monoblock 101*a*.

The addition of the step 138*a* in the region of the input/output through-hole 148*a* also advantageously allows the monoblock 101*a* to be manufactured with input/output through-holes extending fully through the monoblock 101*a* rather than only partially therethrough as with the blind holes disclosed in U.S. Pat. No. 5,926,079 which are more difficult to manufacture.

Thus, in accordance with the present invention, the external bandwidth of a waveguide filter may initially be adjusted either by increasing or decreasing the size (i.e., the depth or thickness) of the first and second "step down" or "step in" steps 136 and 138 of the waveguide filter 100 depicted in FIGS. 1 and 2 or by increasing or decreasing the size (i.e., the height) of the "step up" or "step out" step 138*a* shown in FIG. 2A.

Figure 5:
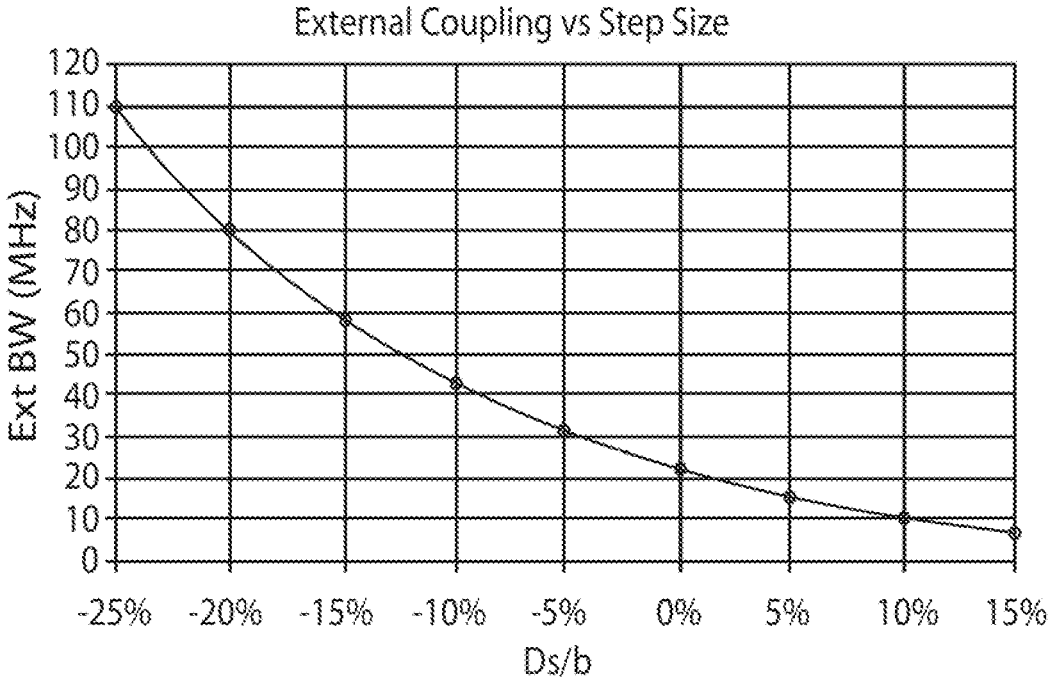
FIG. 5 is a graph depicting the change in the external bandwidth (MHz) or coupling of a ceramic waveguide filter of the type shown in FIGS. 1, 2, and 2A in response to a change in the size (height/thickness) and direction of the steps formed on the ceramic dielectric waveguide filter shown in FIGS. 1, 2 and 2A.

FIG. 5 is a graph which depicts and represents the simulated change in external bandwidth (Ext BW (MHz)) of a 2.1 GHz waveguide filter 100 as a function of $D_S$/b where: $D_S$ (FIGS. 2 and 2A) is either the depth/thickness of the "step down" or "step in" steps 136 and 138 of the waveguide filter 100 shown in FIGS. 1 and 2 or the height of the "step up" or "step out" step 138*a* in the alternate embodiment described above and shown in FIG. 2A; and b is the height/thickness of the monoblock 101. Specifically, it is noted that the negative values extending along the x axis represent negative "step down" or "step in" steps of varying height/thickness while the positive values represent positive "step up" or "step out" steps of varying height.

The present invention also encompasses and provides another independent means for adjusting the external bandwidth of the waveguide filter 100, i.e., by adjusting/varying the diameter of one or both of the first and second input/output through-holes 146 and 148.

Figure 6:
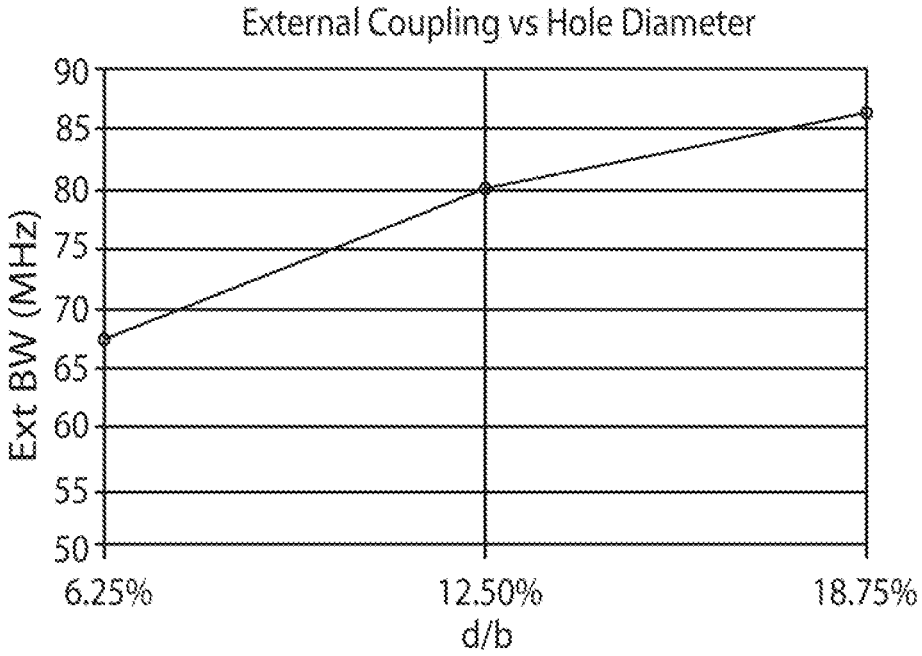
FIG. 6 is graph depicting the change in the external bandwidth (MHz) or coupling of a ceramic dielectric waveguide filter of the type shown in FIGS. 1 and 2 in response to a change in the diameter of the input/output through-holes defined in the ceramic dielectric waveguide filter shown in FIGS. 1 and 2.

FIG. 6 is a graph which depicts and represents the simulated change in the external bandwidth (Ext BW (MHz)) of a 2.1 GHz waveguide filter 100 as a function of d/b where: d is the diameter of the input/output through-holes 146 and 148; and b is the height/thickness of the monoblock 101. Specifically, it is noted that the values expressed in percentages (%) along the x axis represent through-holes increasing from approximately 6.25% of the total height/thickness b of the monoblock 101 to approximately 18.75% of the total height/thickness b of the monoblock 101.

Although not described herein in any detail, it is further understood that the performance of the waveguide filter 100 may be adjusted by adjusting the length of one or both of the steps or notches 136 and 138.

Figure 7:
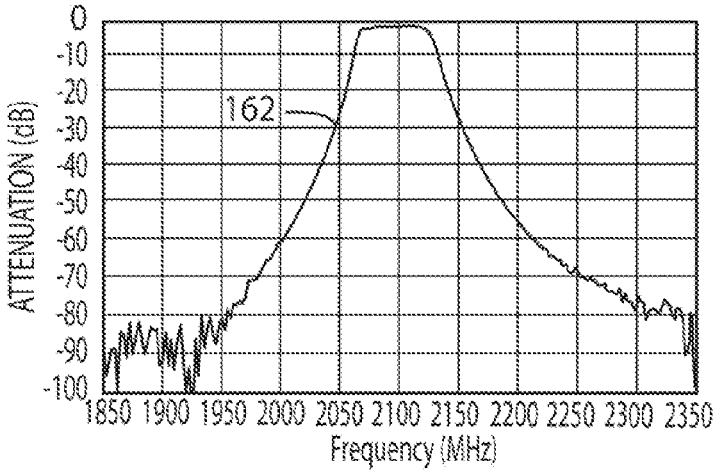
FIG. 7 is a graph representing the performance of the ceramic dielectric waveguide filter shown in FIGS. 1 and 2.

FIG. 7 is a graph representing the actual performance (i.e., line 162) of the waveguide filter 100 shown in FIGS. 1 and 2.

Figure 3:
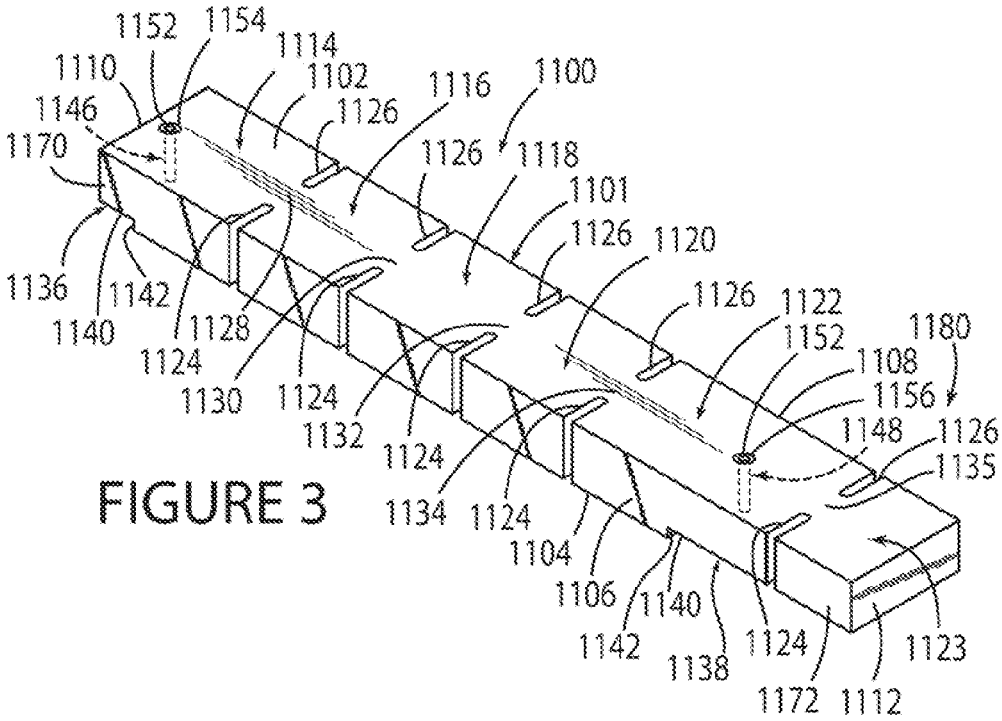
FIG. 3 is an enlarged perspective view of another embodiment of a ceramic dielectric waveguide filter according to the present invention incorporating a shunt zero at one end thereof.
Figure 4:
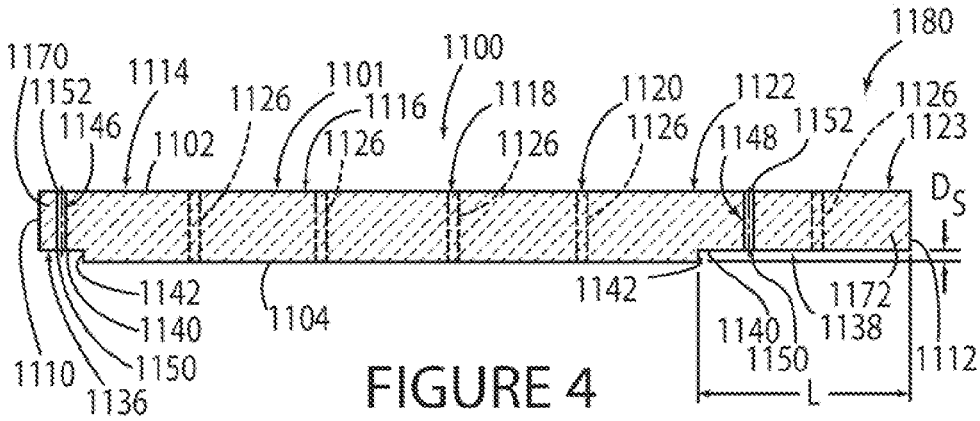
FIG. 4 is an enlarged vertical cross-sectional view of the ceramic dielectric waveguide filter shown in FIG. 3.

FIGS. 3 and 4 depict a second embodiment of a ceramic dielectric waveguide filter 1100 according to the present invention which incorporates a step or notch 1138 at one end of the filter 1100 which, in combination with an RF signal bridge 1136 and input/output through-hole 1148, define a shunt zero 1180 at one end of the filter 1100 as described in more detail below.

The ceramic waveguide filter 1100, in a manner similar to the waveguide filter 100, is also made from a generally parallelepiped-shaped monoblock 1101 of dielectric ceramic material having opposed longitudinal upper and lower horizontal exterior surfaces 1102 and 1104, opposed longitudinal side vertical exterior surfaces 1106 and 1108, and opposed transverse side vertical exterior end surfaces 1110 and 1112.

The monoblock 1101 includes a plurality of resonant sections (also referred to as cavities or cells or resonators) 1114, 1118, 1118, 1120, 1122, and 1123 which are spaced longitudinally along the length of the monoblock 1101 and are separated from each other by a plurality of spaced-apart vertical slits or slots 1124 and 1126 which have been cut into the surfaces 1102, 1104, 1106, and 1108 of the monoblock 1101, in the same manner as described above with respect to the slits or slots 124 and 126 and thus incorporated herein by reference, to define a plurality of generally centrally located RF signal bridges 1128, 1130, 1132, 1134, and 1135 on the monoblock 1101, which are similar in structure and function to the RF signal bridges 128-136 described above and extend between and interconnect the respective resonators 1114, 1116, 1118, 1120, and 1122.

The waveguide filter 1100 and, more specifically, the monoblock 1101 thereof, additionally comprises and defines respective end steps or notches 1136 and 1138, each comprising a generally L-shaped recessed or grooved or shouldered or notched region or section of the lower surface 1104, opposed side surfaces 1106 and 1108, and opposed side end surfaces 1110 and 1112 of the monoblock 1101 from which dielectric ceramic material has been removed or is absent.

Stated another way, and in a manner similar to the steps or notches 1136 and 1138 of the waveguide filter 100 of FIGS. 1 and 2, the first and second steps or notches 1136 and 1138 of the waveguide filter 1100 comprise opposed end sections or regions 1170 and 1172 of the monoblock 1101 having a height/thickness less than the height/thickness of the remainder of the monoblock 1101.

Stated yet another way, each of the steps or notches 1136 and 1138 comprises a generally L-shaped recessed or notched portion of the monoblock 1101 which includes a first generally horizontal surface 1140 located or directed inwardly of, spaced from, and parallel to, the monoblock lower surface 1104 and a generally vertical surface or wall 1142 located or directed inwardly of, spaced from, and parallel to the respective side end surfaces 1110 and 1112 of the monoblock 1101.

The waveguide filter 1100 and, more specifically, the monoblock 1101 thereof, additionally comprises first and second electrical RF signal input/output electrodes in the form of respective first and second through-holes 1146 and 1148 extending between, and in relationship generally normal to, the surface 1140 of the respective steps or notches 1136 and 1138 and the upper surface 1102 of the monoblock 1101. Still more specifically, each of the generally cylindrically-shaped input/output through-holes 1146 and 1148 is spaced from and generally parallel to the respective transverse side end surfaces 1110 and 1112 of the monoblock 1101 and defines respective generally circular openings 1150 and 1152 located and terminating in the step surface 1140 and the monoblock upper surface 1102 respectively.

In a manner similar to that described earlier with respect to the waveguide filter 100, it is understood that all of the external surfaces 1102, 1104, 1106, 1108, 1110, and 1112 of the monoblock 1101 and the internal surfaces of the input/output through-holes 1146 and 1148 are covered with a suitable conductive material such as silver with the exception of respective uncoated (exposed ceramic) generally circular regions or rings 1154 and 1156 on the monoblock upper surface 1102 which surround the openings 1152 of the respective input/output through-holes 1146 and 1148. Although not shown in any of the FIGURES, it is understood that the regions 1154 and 1156 can instead surround the openings 1150 of respective input/output through-holes 1146 and 1148.

The steps or notches 1136 and 1138 of the waveguide filter 1100 provide the same advantages and benefits as the steps or notches 136 and 138 of the waveguide filter 1100, and thus the earlier description of such advantages and benefits is incorporated herein by reference.

The waveguide filter 1100, however, differs from the waveguide filter 100 in that the waveguide filter 1100 additionally comprises a shunt zero 1180 at one end of the monoblock 1101 which is defined and created as a result of the combination of the incorporation of the following features: an end monoblock section 1172 of increased or greater length relative to the opposed end monoblock section 1170 and incorporating and defining an additional end resonator 1123; a step or notch 1138 extending through the end section 1172 and having a length greater than the length of the step or notch 1136 extending through the opposed end monoblock section 1170; the placement and location of the slits 1124 and 1126 defining the RF signal bridge 1135 in the section of the monoblock 1101 including the step or notch 1138 (i.e., in a relationship in which the slits 1124 and 1126 defining the RF signal bridge 1135 extend and slice through the upper longitudinal horizontal surface 1102 of the monoblock 1101 and the lower horizontal surface 1140 of the step or notch 1138 to define the end resonator 1123); and the placement and location of the input/output through-hole 1148 also in the portion of the monoblock 1101 including the step or notch 1138 (i.e. in a relationship wherein the opening 1152 of the input/output through-hole 1148 is located and terminates in the upper longitudinal horizontal surface 1102 of the monoblock 1101 and the opposed opening 1150 of the input/output through-hole 1148 is located and terminates in the step or notch 1138 and, more specifically, in the horizontal surface 1140 of the step or notch 1138).

Thus, in the embodiment shown, the length of the step or notch 1138 is such that it extends past both the slits 1124 and 1126 defining the RF signal bridge 1135 and the RF input/output through-hole 1148 and terminates in a vertical horizontal wall 1140 located in a portion of the monoblock 1101 defining the resonator 1122 which is located adjacent the end resonator 1123 and is separated therefrom by the RF signal bridge 1135.

Still more specifically, in the embodiment of FIGS. 3 and 4, the slits 1124 and 1126 defining the RF signal bridge 1135 and separating the resonators 1122 and 1123 is located in the step or notch 1138 between the input/output through-hole 1148 and the end surface 1112 of the monoblock 1101. Thus, in the embodiment shown, the input/output through-hole 1148 is located in the monoblock 1101 and the notch 1138 between the vertical wall 1142 of the notch 1138 and the slits 1124 and 1126 defining the RF signal bridge 1135.

In accordance with this embodiment of the present invention, the performance or electrical characteristics of the shunt zero 1180 and thus the performance of the waveguide filter 1100 may be adjusted and controlled by varying or adjusting several different parameters including but not limited one or more of the following variables or features: the length of the end monoblock section 1172 and the end resonator 1123; the length L (FIG. 4) of the step or notch 1138; the height/depth/thickness Ds (FIG. 4) of the step or notch 1138; the position or location of the step or notch 1138 on the monoblock 1101; the location of the slits or slots 1124 and 1126 along the length of the step or notch 1138 including the distance between the slits or slots 1124 and 1126 and the block end surface 1112; the size (i.e., width and depth) of the slits or slots 1124 and 1126 in the step or notch 1138; the location of the input/output through-hole 1148 along the length of the step or notch 1138; the diameter of the input/output through-hole 1148; and the width of the monoblock 1101 and/or the width of the end resonator 1123 relative to the width of the remainder of the monoblock 1101.

Figure 8:
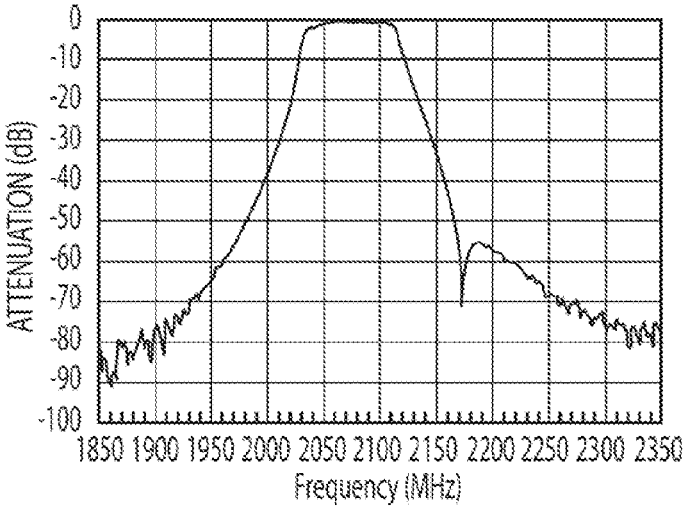
FIG. 8 is a graph representing the performance of the ceramic dielectric waveguide filter shown in FIGS. 3 and 4 with a shunt zero configured above the passband (i.e., a high side shunt zero)
Figure 9:
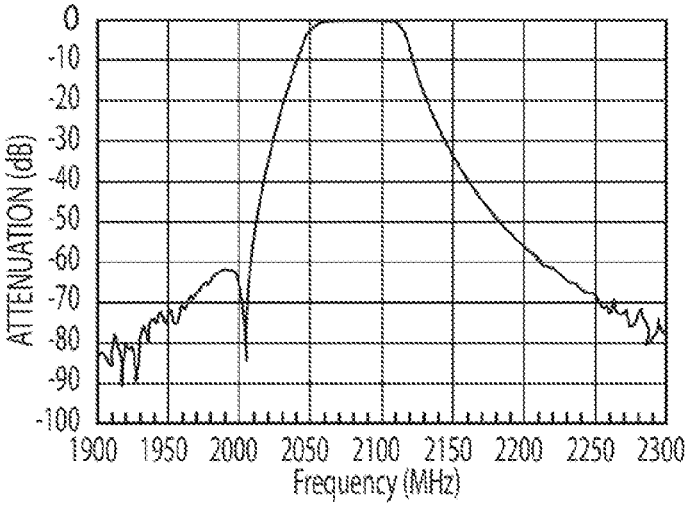
FIG. 9 is a graph representing the performance of the ceramic dielectric waveguide filter shown in FIGS. 3 and 4 with a shunt zero configured below the passband (i.e., a low side shunt zero).

FIGS. 8 and 9 graphically depict and demonstrate the performance (i.e., attenuation as a function of frequency) of a waveguide filter 1100 incorporating either a high side shunt zero (FIG. 8) or a low side shunt zero (FIG. 9). Although not shown in any of the FIGURES or described herein in any detail, it is understood that the length of the shunt zero 1180, and more specifically the length of the end monoblock section 1172 and the end resonator 1123, determines whether the shunt zero will be considered a low side shunt zero or a high side shunt zero and, more specifically, that increasing the length of the shunt zero 1180, and more specifically, increasing the length of the end resonator 1123, will result in a low side shunt zero.

Further, and although not shown or described herein in any detail, it is understood that a similar high or low side shunt zero can be formed in the step or notch 1136 located at the other end of the monoblock 1101 in the same manner as described above with respect to the shunt zero 1180. Still further, it is understood that a similar high or low side shunt zero can be formed in the outward step 138*a* of the waveguide filter 1100 shown in FIG. 2A in a manner similar to that described above with respect to the shunt zero 1180.

While the invention has been taught with specific reference to the embodiments shown, it is understood that a person of ordinary skill in the art will recognize that changes can be made in form and detail without departing from the spirit and the scope of the invention. The described embodiments are to be considered in all respects only as illustrative and not restrictive.

I claim:

1. A waveguide filter comprising:

a monoblock of dielectric material including a plurality of exterior surfaces including opposed upper and lower exterior surfaces, opposed side exterior surfaces, opposed end exterior surfaces and at least one step for adjusting the bandwidth of the waveguide filter including a first exterior surface spaced from and generally parallel to the opposed upper and lower exterior surfaces of the monoblock;

at least one input/output through-hole extending through the monoblock and spaced from the opposed end exterior surfaces of the monoblock, the at least one input/output through-hole defining first and second openings in one of the upper and lower exterior surfaces of the monoblock and the first exterior surface of the at least one step respectively; and at least one slit defined and located in the monablock in a relationship spaced from and opposite the opposed end exterior surfaces of the monoblock, the at least one slit being cut through one of the side exterior surfaces of the monoblock and both of the upper and lower exterior surfaces of the monoblock, the at least one input/output through-hole being located in the monoblock between one of the opposed end exterior surfaces of the monoblock and the at least one slit, and the at least one step terminating in a second exterior surface spaced from the at least one slit.

2. The waveguide filter of claim 1, wherein the first exterior surface of the at least one step defines a notch in the monoblock and the second opening of the at least one input/output through-hole terminates in the notch.

3. A waveguide filter comprising a monoblock of dielectric material including a plurality of exterior surfaces including opposed upper and lower exterior surfaces and opposed side exterior surfaces, opposed first and second ends, at least a first step defined at the first end of the monoblock, and at least a first input/output through-hole extending through the monoblock and terminating in an opening in one of the opposed upper and lower exterior surfaces of the monoblock and in the first step respectively, and a plurality of resonators defined in the monoblock between the at least a first input/output through-hole and the second end of the monoblock and separated by at least a first slit cut through one of the side exterior surfaces of the monoblock and both of the upper and lower exterior surfaces of the monoblock, and wherein the at least first step does not extend into the at least first slit.

4. A method of adjusting the bandwidth of waveguide filter comprising at least the following steps:

providing a monoblock of dielectric material including a plurality of exterior surfaces including opposed upper and lower exterior surfaces and opposed side exterior surfaces, opposed first and second ends, at least a first step defined at the first end of the monoblock, and at least a first input/output through-hole extending through the monoblock and terminating in an opening in one of the opposed upper and lower exterior surfaces of the monoblock and in the first step respectively, and a plurality of resonators defined in the monoblock between the at least a first input/output through-hole and the second end of the monoblock and separated by at least a first slit cut through one of the site exterior surfaces of the monobiock and both of the upper and lower exterior surfaces of the monoblock, and wherein the at least first step does not extend into the at least first slit; and adjusting the height of the at least first step relative to the upper and lower exterior surfaces of the monoblock to adjust the bandwidth of the waveguide filter.

5. The method of claim 4, wherein the at least a first step is defined by a notch defined in the monoblock and the step of adjusting the height of the at least a first step includes a step of adjusting the height of the notch.

6. The method of claim 4, wherein the at least a first step is defined by a projection on the monoblock and the step of adjusting the height of the at least a first step includes a step of adjusting the height of the projection.

* * * * *